United States Patent [19]

Spiegel et al.

[11] 4,168,715

[45] Sep. 25, 1979

[54] DISHWASHER SOIL SEPARATOR

[75] Inventors: Raymond W. Spiegel, Stevensville; Geoffrey L. Dingler, St. Joseph, both of Mich.

[73] Assignee: Whirlpool Corporation, Benton Harbor, Mich.

[21] Appl. No.: 909,779

[22] Filed: May 26, 1978

[51] Int. Cl.[2] ..... B08B 3/00

[52] U.S. Cl. ..... 134/104; 134/111; 134/176

[58] Field of Search ..... 134/104, 109, 111, 176

[56] References Cited

U.S. PATENT DOCUMENTS

| | | | |
|---|---|---|---|
| 1,971,588 | 8/1934 | Stoddard et al. | 134/104 X |
| 2,657,695 | 11/1953 | Walker | 134/111 |
| 2,700,978 | 2/1955 | Pietsch | 134/104 X |
| 3,313,311 | 4/1967 | Gilson | 134/109 |
| 3,378,018 | 4/1968 | Lawter | 134/109 |
| 3,732,877 | 5/1973 | Kloeg | 134/111 |
| 3,765,430 | 10/1973 | Muller | 134/109 |
| 3,807,419 | 4/1974 | Cushing et al. | 134/104 |
| 3,871,914 | 3/1975 | Goffredo et al. | 134/109 |
| 3,930,879 | 1/1976 | Erickson et al. | 134/109 X |
| 4,088,145 | 5/1978 | Noren | 134/104 |

*Primary Examiner*—Stanley N. Gilreath
*Attorney, Agent, or Firm*—Wegner, Stellman, McCord, Wiles & Wood

[57] ABSTRACT

A dishwasher having improved structure for separating food soil and the like from dishwashing liquid. The soil separating structure is associated with a suction passage leading to a circulation pump of the dishwasher provided for effecting circulation of the dishwashing liquid from a lower sump portion of the dishwasher receptacle back to the dishwashing space for washing dishes and the like therein. The soil separator includes an accumulator wherein the soil is collected for subsequent discharge as desired and structure responsive to a swirling action in the suction passage for effecting a circulation of a portion of the dishwashing liquid between the suction passage and the accumulator. The structure is arranged to utilize the combined swirling and longitudinal movement of the dishwashing liquid in the suction passage for effecting the desired soil separation by centrifugal action. Discarding of the collected soil may be effected by a suitable drain pump connected to the accumulator. The swirling movement of the dishwashing liquid in the suction passage may be effected by a rotary impeller, the circulation of the dishwashing liquid in the dishwashing space may be effected by a centrifugal circulation pump, and the draining of the system may be controlled by a discharge valve. In the illustrated embodiment, each of the impeller and circulation pump is coaxially carried on a common shaft of a single drive motor.

15 Claims, 3 Drawing Figures

DISHWASHER SOIL SEPARATOR

BACKGROUND OF THE INVENTION

1. Field of the Invention

This invention relates to dishwashers and in particular to means for separating soil from the dishwashing liquid in an automatic dishwashing appliance.

2. Description of the Prior Art

In one conventional form of automatic dishwashing appliance, dishwashing liquid is circulated through a dishwashing space by means of a circulation pump. The dishwashing liquid is collected in a sump portion of the receptacle defining the dishwashing space and is delivered to the pump through a suction passage. The pump discharges the dishwashing liquid through a delivery passage, such as to a rotary spray arm for spraying the dishes in the dishwashing space, or to other conventional means for delivering the dishwashing liquid in washing association with the dishes.

During the course of the dishwashing operation, soil, such as particulate food material, is picked up by the dishwashing liquid. It is desirable to separate the soil from the liquid so as to minimize the subsequent rinsing operation necessary to complete thorough cleaning of the dishes. A number of different devices have been developed for effecting such soil separation.

Illustratively, in U.S. Pat. No. 1,971,588 of Edgar S. Stoddard et al., a dishwashing machine is shown wherein the dishwashing liquid is delivered to a sump adjacent a rotary impeller. The impeller and sump are cooperatively arranged so as to cause the particular material to move outwardly towards the circumferential wall portion of the sump and then downwardly along a bottom wall portion thereof into a collecting chamber. The impeller acts on the liquid inwardly of the circumferential wall of the sump so as to throw the dishwashing liquid, which has been thusly freed of a portion of the soil, back into the dishwashing space. The collected soil may be discharged through a drain duct by suitable valve control means.

Forrest A. Walker shows, in U.S. Pat. No. 2,657,695, a dishwashing apparatus provided with a centrifugal separation pump wherein the soil is carried down into a vat by the downflow of the dishwashing liquid to be forced outwardly by the centrifugal action of the impeller toward an outside wall of the sump. A perforated barrier is provided inwardly of the sump space so as to intercept food particles tending to move to the impeller thereby holding the soil in the sump space between the perforated barrier and the outer sump wall.

In U.S. Pat. No. 2,700,973 of Joseph A. Pietsch, a dishwasher with a soil separation chamber is shown wherein the dishwashing liquid is caused to flow along an inclined wall into overlying relationship with a depending sump portion in which the soil tends to collect.

Helmut Muller, in U.S. Pat. No. 3,765,430, shows an automatic dish rinsing machine having a centrifugal force separator wherein the circulation pump includes a second outlet for delivering a portion of the dishwashing liquid to a centrifugal separator in parallel with the main return flow of the dishwashing liquid to the dishwashing space.

SUMMARY OF THE INVENTION

The present invention comprehends a dishwasher structure having an improved means for effecting removal of soil from the dishwashing liquid in the operation of the dishwasher.

More specifically, the invention comprehends a dishwasher having a receptacle defining a dishwashing space, a circulation pump having an inlet and an outlet means, a suction passage connecting a lower portion of the receptacle to the inlet of the pump, and means defining a delivery passage connecting the outlet of the pump to an inlet to the dishwashing space whereby dishwashing liquid may be circulated through said dishwashing space for washing dishes therein, an accumulator defining a settling space and a flow conducting space having an inlet and an outlet, a separator associated with the suction passage and having first and second ports connecting with the flow conducting space inlet and outlet respectively, means for swirling the dishwashing liquid in the suction passage thereby urging the liquid toward each of the ports, the ports and liquid swirling means being cooperatively arranged to cause the dishwashing liquid to tend to flow outwardly from the suction passage through the first port and inwardly to the suction passage through the second port thereby causing a portion of the dishwashing liquid being delivered to the pump through the suction passage to be directed through the first port into the accumulator settling space to have particulate matter in the diverted portion of the dishwashing liquid settled out therefrom into the settling space, the diverted portion being returned to the suction passage through the second port as discussed above, and means for selectively discharging the settled-out particulate material from the settling space.

The means for selectively discharging the settled-out particulate material may include a valved outlet which may act to permit discharge of the dishwashing liquid from the separator concurrently through both ports and the accumulator whereby the dishwashing liquid may flow through the accumulator to the valved outlet carrying with it the collected soil for discharge, such as to a conventional drain.

The means for effecting the swirling movement of the dishwashing liquid in the suction passage may comprise a rotary impeller within the suction passage, and more specifically, a rotary impeller disposed therein upstream of the ports. A differential pressure between the ports may be effected by suitably directing the ports relative to the swirling movement of the liquid through the suction passage.

In the illustrated embodiment, the ports are circumferentially spaced with the first port opening oppositely to the swirling movement of the liquid and the second port opening in the direction of swirling movement of the liquid.

In the illustrated embodiment, the impeller and the circulation pump may be coaxially mounted to a common shaft of a single drive motor for improved construction economies.

The dishwasher structure of the present invention is extremely simple and economical of construction while yet providing the highly desirable improved functioning discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
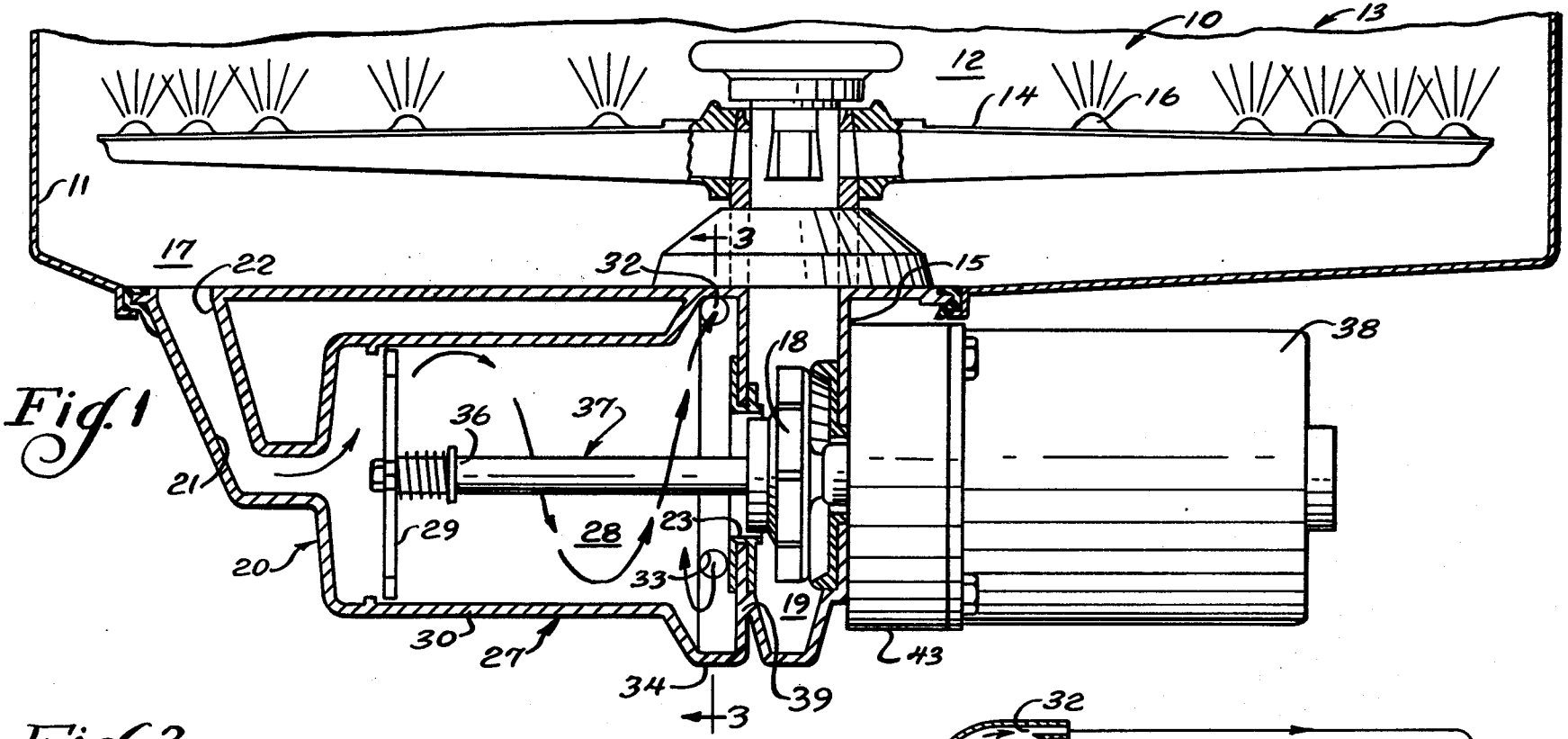
FIG. 1 is a fragmentary vertical section of a dishwasher structure having a soil separating means embodying the invention.

In the exemplary embodiment of the invention as disclosed in the drawing, a washing appliance generally designated 10 illustratively comprises a dishwasher having a tub 11 defining a dishwashing space 12. Dishes to be washed (not shown) are disposed within the space 12 to be washed by means of a plurality of jets 13 delivered from a rotating spray arm 14 in a conventional manner. The spray arm may be carried rotatably on a hollow shaft 15 which conducts the washing liquid upwardly into the spray arms and outwardly through suitable apertured outlets 16 on the spray arm. The lower portion 17 of the tub 11 defines a sump for collecting the dishwashing liquid.

The dishwashing liquid is circulated to the dishwashing space by a centrifugal pump generally designated 18 disposed in a pump chamber 19 at the lower end of shaft 15. Dishwashing liquid is delivered from the sump 17 through a passage 21 defined by a wall structure generally designated 20 having an inlet 22 opening to the sump 17 and an outlet 23 opening to the pump chamber 19.

The passage 21 is further defined by a centrifugal separator 27 including an annular housing wall 30 defining a separator chamber 28. The chamber 28 opens through the outlet 23 into the pump chamber 19. Separator 27 includes a rotary separating impeller 29 for swirling the dishwashing liquid as it flows through the separator. The apparatus further includes an accumulator tank 24 having a lower settling portion 25 and an upper flow conducting portion 26.

The separator 27 is further defined by a pair of ports 32 and 33 in housing wall 30 communicating with the flow conducting portion 26 of the accumulator 24. As shown, ports 32 and 33 are provided in an enlarged annulus 34 of the wall 30. Opening 23 may be defined by a transverse baffle wall 39 providing controlled flow of the dishwashing liquid to the pump 18 and acting in the manner of a baffle at the downstream side of the annular space defined by annulus 34 to provide improved directing of the soil and food particles into the annular space. Impeller 29 is carried on the end 36 of a drive shaft 37 driven by an electric motor 38, such as at about 3400 RPM, so as to swirl the dishwashing liquid in separator space 28 about axis 35 at relatively high speed and thereby cause centrifugal separation of soil in the wash water. As best shown in FIG. 1, the centrifugally separated soil, as a result of the concurrent longitudinal flow of the wash water through the separator, tends to collect in the annulus 34 where it is directed outwardly through opening 32 to accumulator tank 24.

In the illustrated embodiment, the port 32 opens to the chamber 28 substantially oppositely to the direction of swirling of the dishwashing liquid and port 33 opens to chamber 28 at least to some extent in the direction of swirling. Thus, the swirling liquid is urged outwardly through port 32 and inwardly through port 33 as a result of the pressure differential created between the ports. Thus, as soil collects in the annulus 34, it is bled off and circulated through the accumulator tank 24 where it settles out into the lower portion 25 of the tank 24.

In the illustrated embodiment, the flow rate through the accumulator can be controlled by adjusting the orientation of the ports relative to the direction of swirling.

Thus, the dishwashing liquid is continuously automatically cleansed by separating out therefrom of food particles and soil as the dishwashing liquid is passed through the accumulator tank.

A discharge tube 40 from accumulator tank 24 is connected through a conventional solenoid valve 41 and a transfer line 42 to a drain pump 43 which is driven by motor 38 coaxially with pump 18 and impeller 29. When valve 41 is opened, pump 43 rapidly pumps the liquid in accumulator 24 to drain thusly flushing the collected soil from the tank and draining the dishwasher in a conventional manner.

In the operation of the dishwasher, a suitable quantity of dishwashing liquid is introduced into the tub 11. To effect the washing of the dishes, motor 38 is suitably energized so as to cause operation of pump 18. The dishwashing liquid collected in the sump portion 17 of the tub passes downwardly through the suction passage 21 to the pump chamber 19 wherein the pump 18 forcibly pumps the dishwashing liquid up through the hollow shaft 15 and spray arm 14 to provide the dishwashing jets 13 as discussed above. The sprayed dishwashing liquid then falls back to the sump for recirculation by the pump in this manner.

Figure 3:
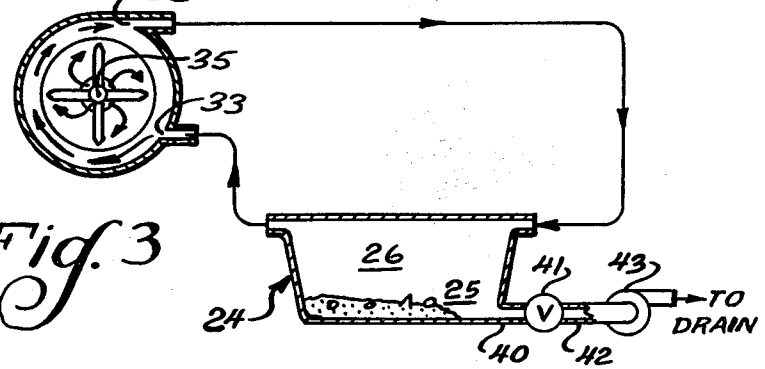
FIG. 3 is a fragmentary vertical section taken substantially along the line 3—3 of FIG. 1.
Figure 2:
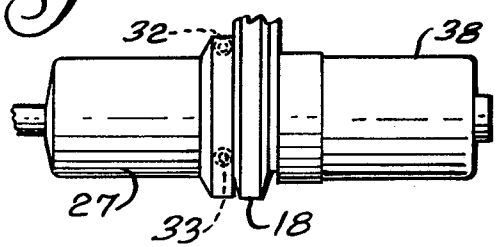
FIG. 2 is a side elevation of the separator-pump structure thereof.

As food particles and soil are washed from the dishes, they are entrained in the dishwashing liquid as it is brought back through the suction passage 21 toward pump 18. The food particles and soil are centrifugally separated from the returning dishwashing liquid by the action of separator 27 and collected in accumulator tank 24. Thus, as the dishwashing liquid carrying the soil passes through the separator 27, the impeller 29 thereof causes a swirling movement about the axis 35 of the separator chamber. The centrifugal movement of the dishwashing liquid causes separation of entrained soil and as a result of the arrangement of ports 32 and 33, as discussed above, a portion of the dishwashing liquid containing concentrated soil is bypassed through accumulator tank 24 wherein the soil settles out into lower space 25. Since the soil and the other particulate material is dropped from the flowing liquid into the settling portion 25, as shown in FIG. 3, relatively clean dishwashing liquid is returned to the separator space through opening 33 and then into the pump chamber 19. The thusly cleansed dishwashing liquid is then repumped by pump 18 through the spray arm 14, as discussed above, for an improved further cleaning of dishes and the like in the dishwashing space 12.

When it is desired to drain the dishwasher, the valve 41 is opened and drain pump 43 pumps the dishwashing liquid to drain. Dishwashing liquid is thusly caused to flow outwardly through the ports and the accumulator to drain. The dishwashing liquid passes downwardly through the flow conducting space 26 to the settling space 25 to be discharged through discharge tube 40 and transfer line 42, to drain. This flow of the dishwashing liquid effectively flushes out the settling portion 25 so as to effectively rid the system of the accumulated soil which had been removed from the dishwashing liquid during the dishwashing operation as discussed above. Thus, the apparatus provides a self-cleansing functioning every time the dishwasher is drained, eliminating the collected food material in a novel and simple manner.

In order to provide an effective flushing action, a relatively high flow rate of the draining liquid is provided by making the ports 32 and 33 of relatively large size thereby allowing for quick passage of large quantities of the liquid. As discussed above, the orientation of the ports 32 and 33 may be adjusted so as to permit the desired low flow rate necessary to allow soil to settle in the accumulator 24 during operation of the circulating pump while allowing the high flow rate necessary to flush out the accumulator during operation of the drain pump.

Thus, the invention comprehends providing means in the separator portion of the system for causing a swirling movement about the longitudinal axis of the separator of the dishwashing liquid flowing therethrough toward the recirculating pump. The accumulator defines means for automatically separating particulate material from the dishwashing liquid as a result of circulation of a portion of the dishwashing liquid from and to the suction passage during the recirculating operation of the dishwashing pump.

The foregoing disclosure of specific embodiments is illustrative of the broad inventive concepts comprehended by the invention.

We claim:

1. In a dishwasher having a receptacle defining a dishwashing space, a circulation pump having an inlet and an outlet, means defining a suction passage connecting a lower portion of the receptacle to the inlet of the pump, and means defining a delivery passage connecting the outlet of the pump to an inlet to the dishwashing space wherein dishwashing liquid may be circulated through said dishwashing space for washing dishes therein by removing food particles and soil therefrom, the improvement comprising:

an accumulator defining a settling space portion and a flow conducting space portion having an inlet and an outlet;

a separator defining a portion of said suction passage and having an annular outer wall provided with first and second ports connecting with said flow conducting space portion inlet and outlet respectively, and means for swirling the dishwashing liquid flowing through said separator passage portion to urge the food particles and soil centrifugally outwardly toward said annular outer wall, said ports being cooperatively arranged to cause a pressure condition of the dishwashing liquid developed at said first port to be higher than the pressure condition thereof developed at said second port thereby causing a portion of the dishwashing liquid being delivered toward said circulation pump inlet in said separator passage portion to be diverted through said first port into said flow conducting space portion of the accumulator to have said food particles and soil in the diverted portion of the dishwashing liquid settle out therefrom into said settling space portion and the cleansed diverted portion to be returned to said separator passage portion through said second port as a result of the pressure differential existing between said ports; and means for selectively discharging the settled-out food particles and soil from said accumulator.

2. The dishwasher apparatus of claim 1 wherein said means for selectively discharging the settled-out food particles and soil comprises a valved outlet from said settling space permitting, when open, the dishwashing liquid to flow concurrently outwardly through both of said first and second ports and thence through said accumulator.

3. The dishwasher apparatus of claim 1 wherein said means for selectively discharging the settled-out food particles and soil comprises a valved outlet from said settling space and pump means for causing the pressure of the liquid at said valved outlet to be less than that at said ports whereby dishwashing liquid is urged outwardly through both ports concurrently and through said accumulator to said valved outlet thereby to flush the particulate material from the accumulator and drain the dishwashing space.

4. The dishwasher apparatus of claim 1 wherein said means for swirling the dishwashing liquid comprises a rotary impeller, said circulator pump and impeller being coaxially mounted to a drive motor.

5. The dishwasher apparatus of claim 1 wherein said first port opens into the radially outer portion of said separator passage portion adjacent said annular outer wall in a direction opposite to the direction of swirling of the dishwashing liquid.

6. The dishwasher apparatus of claim 1 wherein said first port opens into the radially outer portion of said separator passage portion adjacent said annular outer wall in a direction opposite to the direction of swirling of the dishwashing liquid and said second port opens into said radially outer portion adjacent said annular outer wall in the direction of swirling of the dishwashing liquid whereby the portion of the dishwashing liquid carrying the centrifugally outwardly urged food particles and soil is urged outwardly through said first port and the cleansed portion of the diverted liquid returned from said accumulator outlet is urged inwardly from said second port.

7. The dishwasher apparatus of claim 1 wherein said first port opens tangentially into the radially outer portion of said separator passage portion adjacent said annular wall in a direction opposite to the direction of swirling of the dishwashing liquid.

8. The dishwasher apparatus of claim 1 wherein said means for swirling the dishwashing liquid comprises a rotary impeller driven concurrently with said circulation pump.

9. In a dishwasher having a receptacle defining a dishwashing space, a circulation pump having an inlet and an outlet, means defining a suction passage connecting a lower portion of the receptacle to the inlet of the pump, and means defining a delivery passage connecting the outlet of the pump to an inlet to the dishwashing space wherein dishwashing liquid may be circulated through said dishwashing space for washing dishes therein by removing food particles and soil therefrom, the improvement comprising:

an accumulator defining a settling space portion and a flow conducting space portion having an inlet and an outlet;

a separator defining a portion of said suction passage connected to the inlet of the pump and having a tubular outer wall defining an enlarged annular space adjacent said inlet of the pump, a first port opening to said enlarged annular space and connecting with said flow conducting space inlet, and a second port opening to said enlarged annular space and connecting with said flow conducting space outlet, and an impeller for swirling the dishwashing liquid flowing through said separator passage portion to urge the food particles and soil centrifugally outwardly toward said tubular outer wall and into said annular space, said first and second ports being arranged to cause the dishwashing liquid to be urged outwardly at said first port and urged inwardly at said second port thereby causing a portion of the dishwashing liquid being delivered toward said pump in said separator passage portion to flow outwardly through said first port and thereby carry said centrifugally urged food particles and soil into said accumulator to have said food particles and soil settle out from the dishwashing liquid into said settling space portion, the cleansed dishwashing liquid being urged back into said separator passage portion through said second port; and means for selectively discharging the settled-out food particles and soil from said accumulator.

10. The dishwasher apparatus of claim 9 wherein said first port opens tangentially to said tubular wall in a direction opposite to the direction of swirling of the dishwashing liquid whereby the swirling dishwashing liquid is urged substantially directly into said first port.

11. The dishwasher apparatus of claim 1 wherein the swirling action of said impeller and longitudinal flow action of the pump in said separator cause the pressure of the dishwashing liquid in said annular space to be greater than the pressure at said circulator pump inlet.

12. The dishwasher apparatus of claim 1 wherein a radial baffle is provided at the downstream side of the annular space for blocking flow of the swirling dishwashing liquid directly to the circulation pump.

13. The dishwasher apparatus of claim 9 wherein said ports open in opposite circumferential directions through the tubular outer wall.

14. The dishwasher apparatus of claim 9 wherein said second port opens in the direction of swirling of the dishwashing liquid whereby the swirling dishwashing liquid flowing past said second port urges liquid into said separator from said second port.

15. The dishwasher apparatus of claim 9 wherein said ports are equally spaced from the axis of the tubular wall.

* * * * *